US005321955A

United States Patent [19]

Leonard

[11] Patent Number: 5,321,955

[45] Date of Patent: Jun. 21, 1994

[54] CRYOGENIC SHIPPING SYSTEM

[76] Inventor: Rex D. Leonard, 6006 Corporate Way, Indianapolis, Ind. 46278

[21] Appl. No.: 995,124

[22] Filed: Dec. 22, 1992

[51] Int. Cl.[5] ..... F25B 19/00; F25B 21/00; F24F 3/16

[52] U.S. Cl. ..... 62/51.1; 62/78; 62/457.9

[58] Field of Search ..... 62/51.1, 60, 64, 78, 62/371, 373, 457.9; 220/901, 254, 342, 697

[56] References Cited

U.S. PATENT DOCUMENTS

| | | | |
|---|---|---|---|
| 1,813,190 | 7/1931 | Morin | 220/14 |
| 2,706,895 | 4/1955 | Thompson et al. | 62/373 |
| 3,052,370 | 9/1962 | Haumann et al. | 220/17 |
| 3,168,362 | 2/1965 | Perkins | 312/214 |
| 3,187,937 | 6/1965 | Berta | 220/94 |
| 3,303,667 | 2/1967 | Perkins | 62/457.9 |
| 3,707,079 | 12/1972 | Hawker | 62/373 X |
| 3,875,754 | 4/1975 | Faust et al. | 62/60 |
| 4,030,314 | 6/1977 | Strehler et al. | 62/78 X |
| 4,055,268 | 10/1977 | Barthel | 220/9 C |
| 4,149,388 | 4/1979 | Schneider et al. | 62/50 |
| 4,154,363 | 5/1979 | Barthel | 220/421 |
| 4,211,086 | 7/1980 | Leonard et al. | 62/50 |
| 4,314,450 | 2/1982 | Pelloux-Gervais | 62/51.1 |
| 4,455,842 | 6/1984 | Granlund | 62/78 X |
| 4,757,692 | 7/1988 | McDonald | 62/51.1 X |
| 4,838,034 | 6/1989 | Leonard et al. | 62/50.2 |
| 4,918,927 | 4/1990 | Eigenbrod | 62/45.1 |
| 4,958,498 | 9/1990 | Brothers | 62/457.9 X |
| 5,168,725 | 12/1992 | Margolin | 62/457.9 |

FOREIGN PATENT DOCUMENTS

| | | | |
|---|---|---|---|
| 137754 | 9/1979 | Fed. Rep. of Germany | 62/51.1 |
| 1434219 | 10/1988 | U.S.S.R. | 62/51.1 |

OTHER PUBLICATIONS

*Vapor Shippers*; Advertising Brochure for Minnesota Valley Engineering, Inc.; Two Appletree Square, Suite 100, 8011 34th Avenue South, Bloomington, Minn.

*Dewars*; Advertising Brochure; 2 pages.

*Artic Express TM Cyrogenic Dry Shipper*; Advertising Brochure; 1 page.

*Primary Examiner*—Henry A. Bennet

*Assistant Examiner*—C. Kilner

[57] ABSTRACT

A cryogenic shipping and storage system includes a cryogenic dewar having a top opening, one or more specimen holders suspended within the dewar, a top housing secured to dewar opening and forming a central opening corresponding with the top dewar opening to allow insertion and withdrawal of the one or more specimen holders, a plug adapted to engage the one or more specimen holders and close the central opening of the top housing, a top cover hingedly carried by the top housing over the central opening, and indicia provided on the top housing to identify each of the one or more specimen holders suspended within the dewar. The top housing includes means for detachably receiving and maintaining the spaced relationship of the one or more specimen holders suspended within the cryogenic dewar. The specimen holder includes an elongated support having a tortuously shaped portion to permit the unobstructed removal of the specimen holder from the interior of the dewar and a dewar-engaging portion projecting from the elongated support so that, when the specimen holder is suspended within the dewar, the specimen holder is urged by gravity away from contact with other specimen holders secured within the dewar.

18 Claims, 7 Drawing Sheets

CRYOGENIC SHIPPING SYSTEM

FIELD OF THE INVENTION

This invention relates to cryogenic vessels and, more particularly, to cryogenic shipping dewar systems including improved sample holders and an improved housing cover including features to detachably secure and identify and lock the sample holders within the cryogenic dewar.

BACKGROUND OF THE INVENTION

Various uses for cryogenic systems are known. Such uses include providing oxygen supplementation for persons having restricted breathing and providing pneumatic power for small hand tools. Examples of such prior systems are disclosed in U.S. Pat. Nos. 4,149,388; 4,211,086; and 4,838,034.

Cryogenic systems have also long been utilized in the storage and transporting of specimens including human and animal body fluids such as animal semen. Such systems commonly employ a cryogenic dewar to store and/or transport the specimens. Shown in FIG. 1 is such a conventional system comprising a cryogenic dewar that typically includes an inner vessel and an outer container, each having a central opening at their tops, a neck portion providing an air tight connection between the openings of the inner vessel and the outer casing at their tops, thereby forming an evacuable space therebetween, and one or more sample or specimen holders, each provided with an elongated support with a hook at its distal end to engage the top of the dewar. The sample holders are typically immersed in a bath of liquid cryogen, commonly nitrogen, maintained in the inner vessel. The bottom of the inner vessel is provided with means, such as a spider, to maintain the spacing of the specimen holders within the inner vessel to avoid their mutual interference upon insertion and removal. The central opening of the dewar is typically closed or fitted with a foam plug.

The existing cryogenic systems have, however, not been entirely satisfactory. The sample holders have been difficult to identify and difficult to remove from the dewar without interference with other sample holders and the interior surfaces of the dewar itself.

SUMMARY OF THE INVENTION

This invention provides a cryogenic shipping dewar system including an improved sample holder and an improved top housing and cover. The top housing includes means to detachably secure, identify and lock the sample holders within the cryogenic shipping dewar. An improved specimen or sample holder of this invention comprises an open-end cylindrical canister and an elongated support connected adjacent the open end of the canister. The canister is suited for containing human and animal body fluid samples, particularly semen samples. The elongated support extends generally parallel with a central longitudinal axis of the canister and has at its distal end a projecting portion that extends generally over and beyond the central portion of the canister, with a dewar-engaging portion that lies beyond the central portion of the canister. The dewar-engaging portion provides a fulcrum that engages the dewar adjacent the top opening so that when the canister is suspended within the dewar, the canister is urged by gravity in the direction of the projecting portion of the support. The specimen holder can further include a tortuously shaped portion of the elongated support disposed adjacent the canister for preventing the canister from snagging on other canisters within the interior of the dewar as the material holder is being withdrawn from the dewar. The elongated support can even further include a central portion made of thermal insulating material to inhibit the transfer of heat along the support.

The improved top housing of the invention is secured to the top of the dewar and preferably includes an annular portion forming a central opening in communication with the dewar opening to allow the insertion and withdrawal of a plurality of specimen holders into and out of the dewar. The top housing can further include frictional fitting means for detachably securing the specimen holder at a fixed and identifiable location within the cryogenic dewar. The frictional fitting means includes a plurality of detent-forming portions circumferentially spaced about the central opening of the top housing for detachably receiving the dewar-engaging portion of the elongated support a specimen holder. The annular portion can further include an annular rib provided with a plurality of spaced radial passageways for freely receiving the projecting portion of the elongated support of the sample holder wherein each of the passageways is radially aligned with one of the plurality of detent-forming portions of the top cover.

The improved top housing of the invention can also include a hinged transparent cover to close and lock the cryogenic dewar while permitting visual inspection of dewar top and sample holders through the cover. The transparent cover is connected to the top housing of the dewar by a pair of hinges and includes a deformable releasable latch to maintain the cover in a closed position. The cover can further include means so that it may be locked or sealed in the closed position. A plug can be fitted into and close the central opening of the top housing of the dewar and can include a plurality of vertical channels spaced about its periphery to prevent swaying of the specimen holders suspended within the dewar. The top housing can also form handle means for transporting the cryogenic dewar.

This invention provides a cryogenic shipping container for human and biological animal samples comprising a cryogenic dewar having an outer casing and an inner vessel, each having an opening at the top, a neck providing a gas-tight connection between the openings of the outer casing and the inner vessel to provide an evacuated space with thermal insulation therebetween, a top housing secured over the opening of the dewar and adapted to engage a plurality of sample holders, a transparent hinged and lockable cover carried by the top housing over the central opening of the dewar, indicia means provided on the top housing of the dewar for identifying sample holders suspended within the dewar, and one or more easily removable specimen or sample holders that engage the top housing of the dewar to be held in identifiable locations and urged from contact with each other.

Other advantages and novel features of the invention will become apparent from the following detailed description of the invention when considered in conjunction with the accompanying drawings.

BEST MODE FOR CARRYING OUT THE INVENTION

Figure 1:
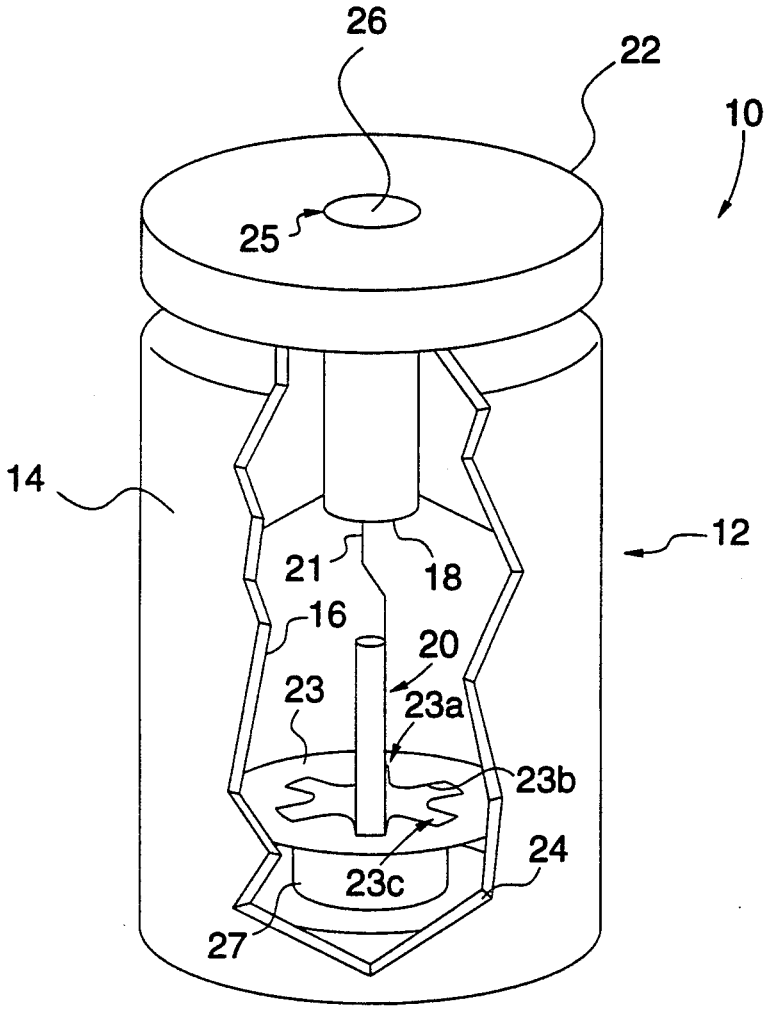
FIG. 1 PRIOR ART
FIG. 1 shows a partially broken away perspective view of a prior art cryogenic shipping vessel.

For purposes of illustration, FIG. 1 presents a prior art cryogenic shipping vessel 10 for storing and transporting specimens, particularly human and animal body fluids such as semen. The prior art cryogenic system 10 of FIG. 1 includes a dewar 12 comprising an outer casing 14 and an inner vessel 16 with each having small openings at their tops connected together by an air-tight neck portion 18, which forms an evacuable space 24 between the outer casing 14 and the inner vessel 16, as well as an opening into the inner vessel 16. Such a conventional system 10 typically includes one or more cylindrical sample or specimen holders 20 provided with an elongated support 21 to engage the top of the dewar so that the sample holder 20 is immersed in a bath of liquid cryogen (not shown) maintained in the inner vessel 16. As shown in FIG. 1, the one or more specimen holders 20 are retained separated from each other adjacent the bottom of the inner vessel 16 by means such as spider 23. Spider 23 is rotatably carried above the bottom of inner vessel 16 by a spider carrier 27. The rotatability of spider 23 within the inner vessel 16 avoids a need to index the rotational position of the inner vessel 16 with respect to outer casing 14. The spider 23 is provided with an inner opening 23*a* which has a scalloped periphery 23*b* to provide a plurality of channels 23*c* to engage the individual specimen holders 20 and maintain their spacing within the inner vessel 16 and reduce their mutual interference when they are inserted and removed from the dewar. Attached to the top of the dewar 12 is a top housing 22 having a central opening 25 formed therein that communicates with the top opening of the dewar 12. The central opening 25 of the top housing 22 is typically closed or fitted with a foam plug shown at 26.

This invention provides a cryogenic shipping dewar system including an improved sample holder and an improved top housing as shown and described in relation to FIGS. 2-8.

Figure 2:
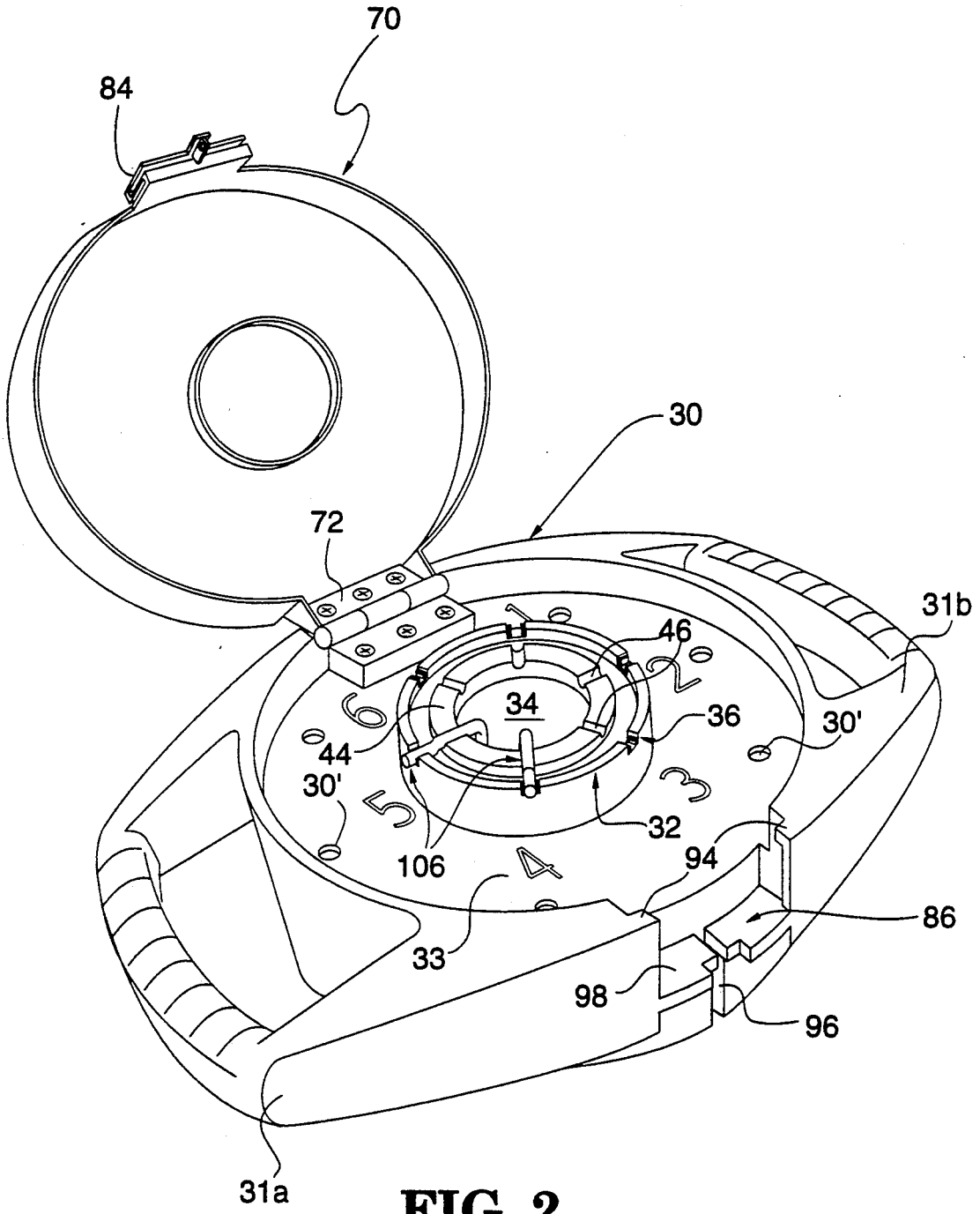
FIG. 2 is a perspective view of a top housing of this invention including a cover and a pair of specimen holders secured thereto.
Figure 3:
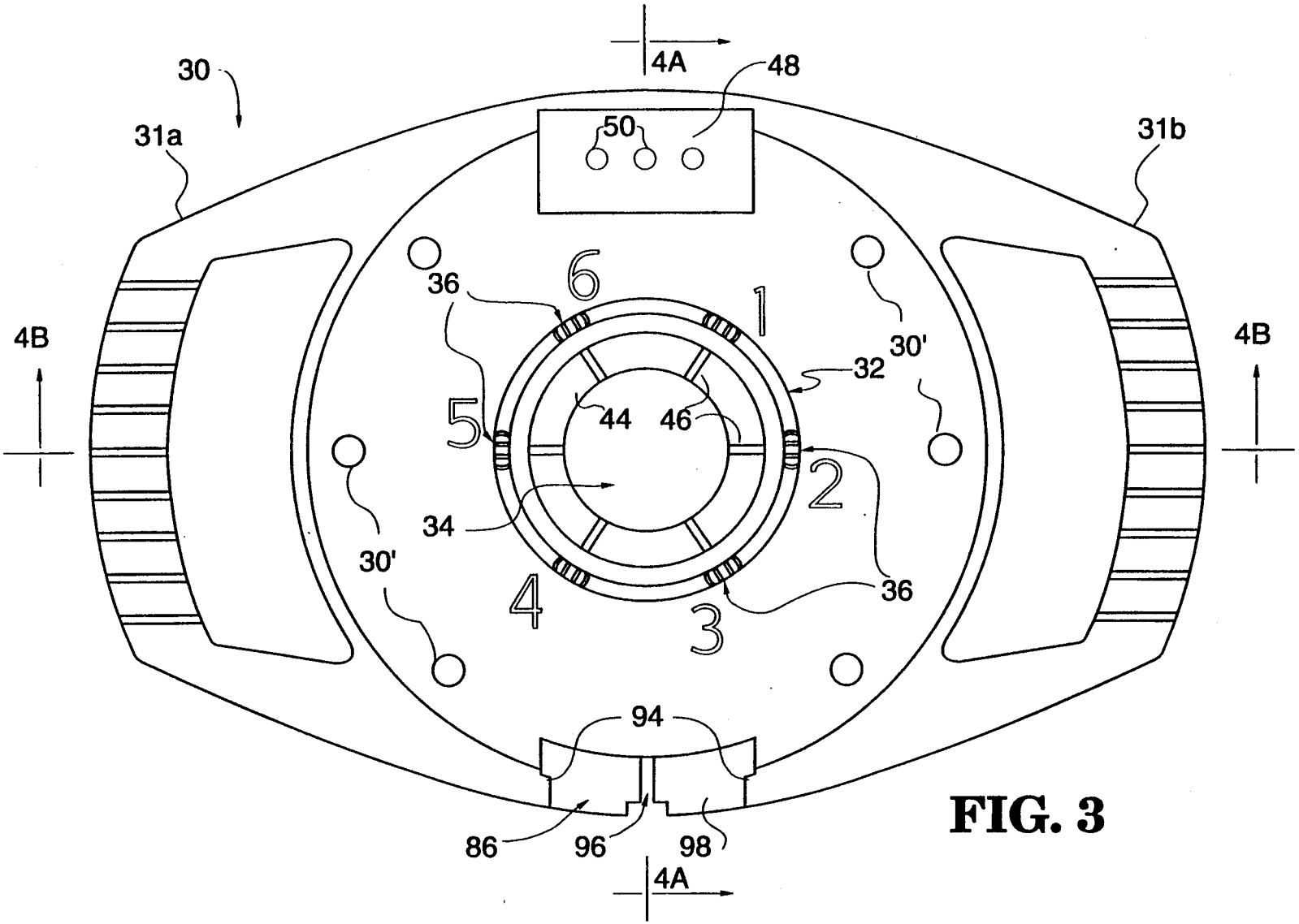
FIG. 3 is a top plan view of the top housing of FIG. 2 without the cover and specimen holders.
Figure 4A:
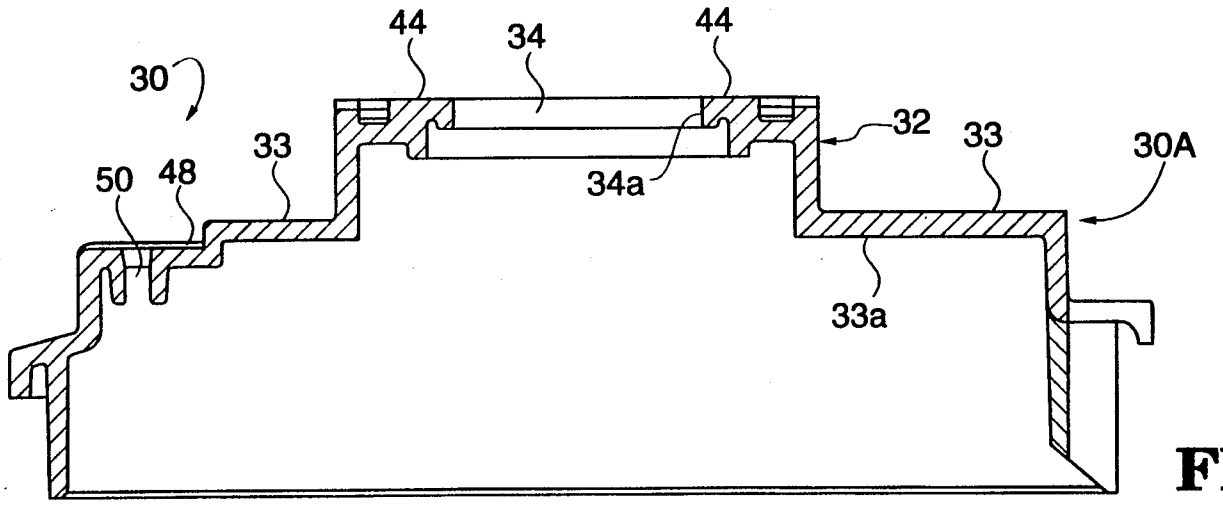
FIGS. 4A and 4B present cross-sectional views taken along line 4A—4A and line 4B—4B, respectively, of the top housing of FIG. 3.
Figure 4B:
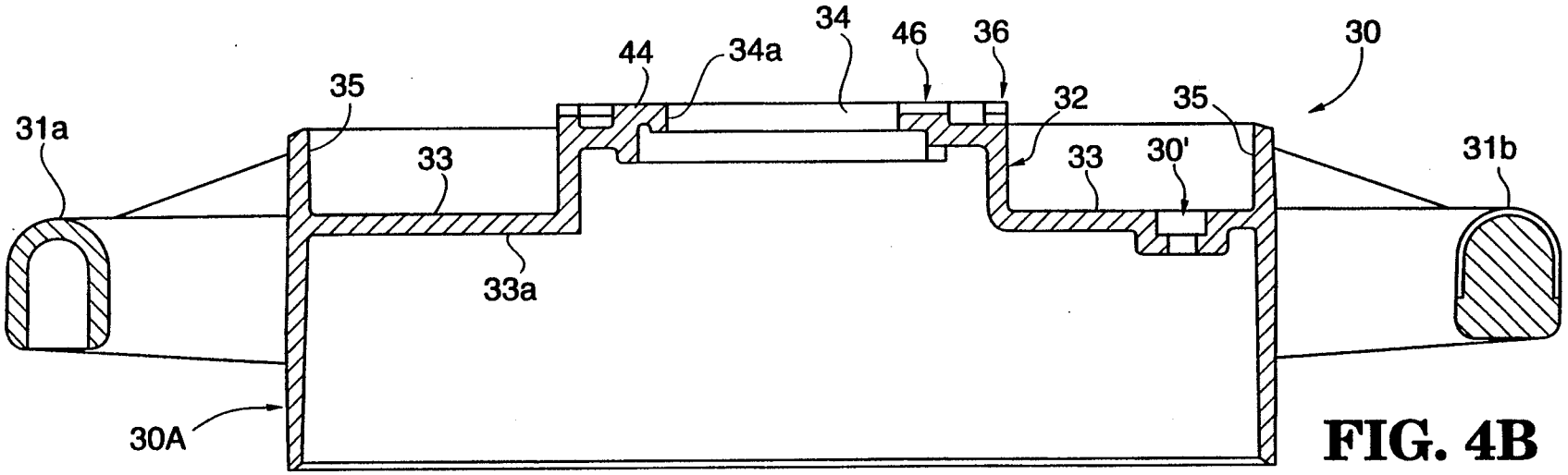
Figure 5A:
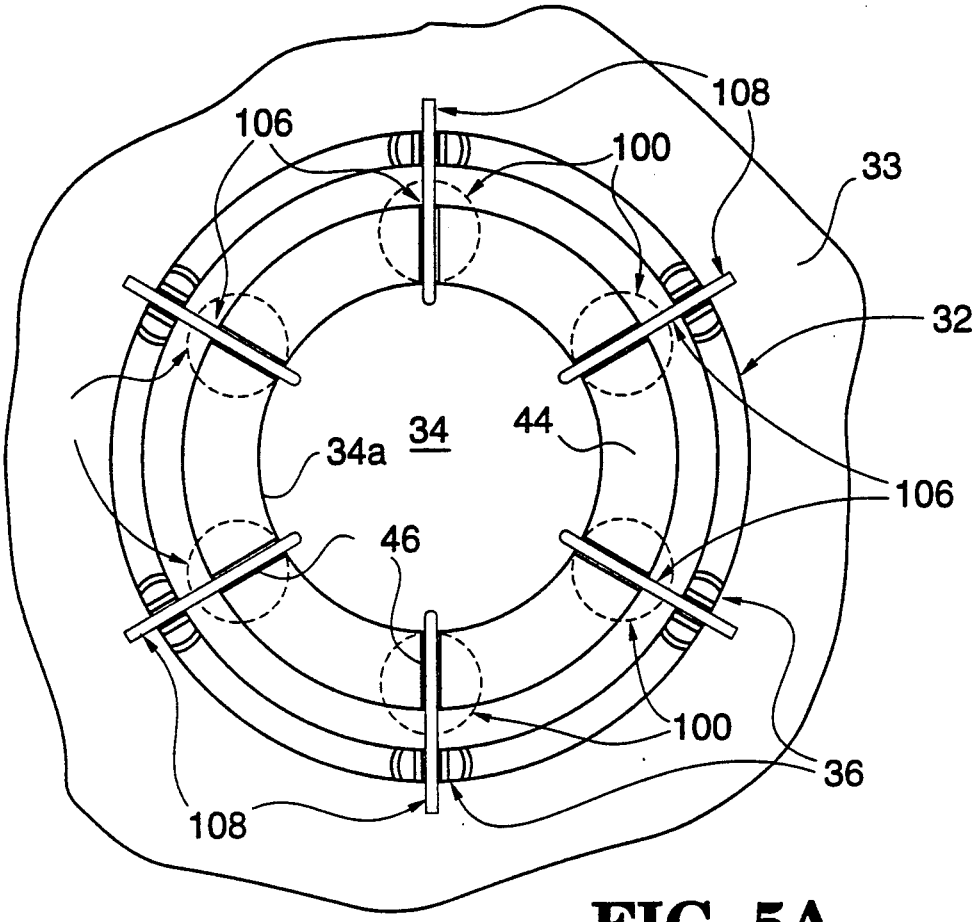
FIG. 5A presents a top plan view in isolation of the annular portion of the top housing of FIG. 2 showing a plurality of specimen holders secured therein.

FIG. 2 presents a perspective view of a top housing assembly provided by this invention including a top housing 30 and a cover 70, and FIGS. 3-5 present further various views of the top housing 30 provided by this invention. Referring particularly to FIGS. 2 and 3, top housing 30 is intended to be secured over the top opening of the dewar to which it is attached and includes means for maintaining a plurality of specimen holders spaced within the dewar defined by an annular portion 32 having a central opening 34, friction-fitting means defined by a plurality of detent-forming portions 36, and an annular rib 44. Central opening 34 corresponds with the top opening of the dewar (not shown) and allows the insertion and withdrawal of specimen holders into and from the dewar. The plurality of detent-forming portions 36 are circumferentially spaced about the central opening 34 and are adapted to releasably receive a dewar-engaging portion 106 of the elongated support 104 of a specimen holder 100 (see FIGS. 8A-8C). The annular rib 44 is disposed between the central opening 34 and the plurality of detent-forming portions 36 and can include a plurality of spaced radial passageways 46 suited for freely receiving and maintaining, as best shown in FIG. 5A, the spacing of the dewar-engaging portions 106 of the specimen holders 100. Each of the plurality of spaced radial passageways 46 combines with one of the plurality of detent-forming portions 36 to fasten and maintain the spacing of a plurality of specimen holders within the dewar.

FIGS. 4A and 4B present cross sectional views taken along reference lines 4A and 4B, respectively, of the top housing 30 shown in FIG. 3. Top housing 30 can be molded from a suitable plastic material such as GE's LEXAN brand polycarbonate. Top housing 30 forms a shell 30A with annular portion 32 rising above a flat planar surface 33 and an outer wall 35 disposed about the periphery of the top housing 30 extending above planar surface 33. The underside surface 33*a* of planar surface 33 is adapted to abuttingly engage the top of the cryogenic dewar so that the top opening of the dewar is in communication with the central opening 34 of top housing 30 and so that top housing 30 may be secured to the dewar with suitable fasteners through a plurality of openings 30' provided in planar surface 33. Top housing 30 is further provided with a recessed portion 48 adjacent one side of its periphery to provide a seat for receiving a hinge device 72 (FIG. 2) for securing the cover 70 to housing 30 employing fastener-receiving holes 50.

Figure 5B:
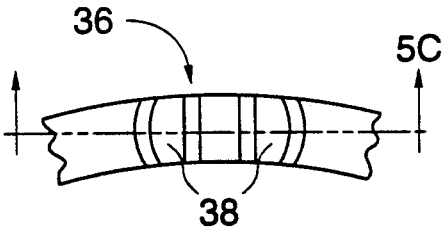
FIGS. 5B and 5C present enlarged isolated views of various aspects of the top housing of FIG. 5A.
Figure 5C:
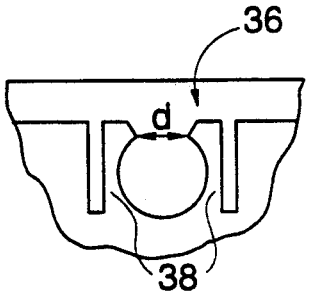

Referring now to FIGS. 5A-5C, FIG. 5A presents a top plan view of the annular portion 32 of top housing 30, FIG. 5B presents an enlarged isolated top view of a single detent-forming portion 36, and FIG. 5C presents an enlarged isolated cross sectional view of the detent-forming portion 36 of FIG. 5B taken along section line 5C.

As can be seen in FIG. 5A, with this invention a plurality of specimen holders 100 (shown in phantom lines in FIG. 5A) can be stored within a cryogenic dewar system, spaced circumferentially about the interior of the dewar, and releasably secured in position to prevent their contacting one another or the interior wall of the dewar. The specimen holders 100 are secured about the annular portion 32 of top housing 30 by frictionally fitting (snapping) the dewar-engaging portion 108 of each specimen holder 100 into the detent-forming portions 36. Each of the detent-forming portions 36 are align with a radial passageway 46, which is defined by a recessed slot in annular rib 44. The projecting portions 106 of the supports for specimen holders 100 are freely received within the radial passageway 46 so that the detent-forming portions 36, in cooperation with radial passageways 46, secure and maintain the holders 100 in a circumferentially spaced relationship within the interior of the dewar as shown in FIG. 5A.

Detent-forming portion 36, as shown in FIGS. 5B and 5C, includes a pair of upwardly projecting legs 38 that are slightly flexible with their upper portions of being spaced apart a selected distance "d" which is slightly lesser than the diameter of the dewar-engaging portion 106 of specimen holder 100. The shorter distance "d" between legs 38 enables the dewar-engaging portions 106 to be "snapped" into place between the legs 38 and be releasably maintained in a fixed circumferential position. Only slight pressure is required to disengage the dewar-engaging portions 106 from the detent-forming legs 38.

Top housing 30 can additionally include indicia for identifying each of the plurality of specimen holders 100 suspended and positioned within the cryogenic dewar. Such indicia can be a plurality of reference numerals disposed on the planar surface 33 of housing 30 as shown in FIGS. 2 and 3, with each reference numeral corresponding to a separate radial passageway 46 and detent-forming portion 36 of annular portion 32. Top housing 30 can even further include a pair of opposed outer portions 31*a* and 31*b* (FIGS. 2 and 3) forming handles for manually transporting the cryogenic dewar system.

Figure 6:
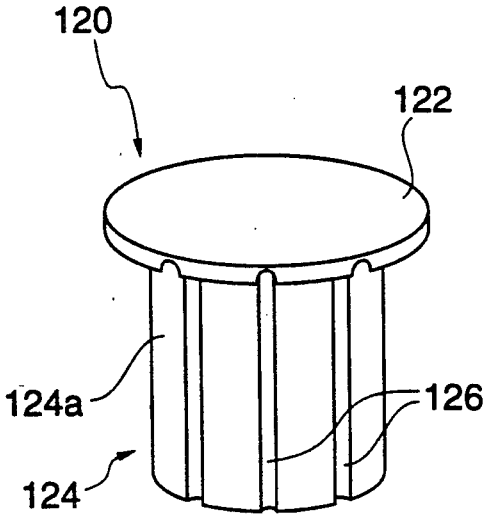
FIG. 6 presents a perspective view of a plug member of this invention for closing the central opening of the top housing best shown in FIGS. 2 and 3.
Figure 7C:
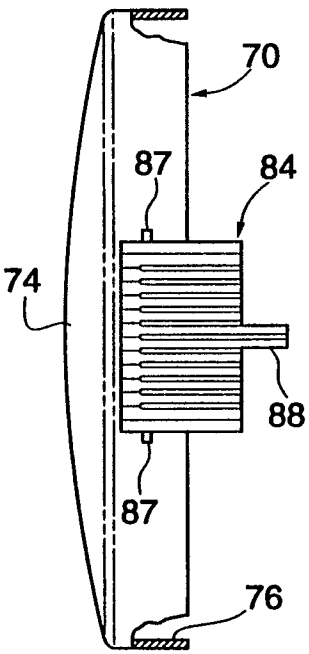
FIGS. 7A-7D present various plan views of a cover of this invention adapted to be secured to the top housing.
Figure 7A:
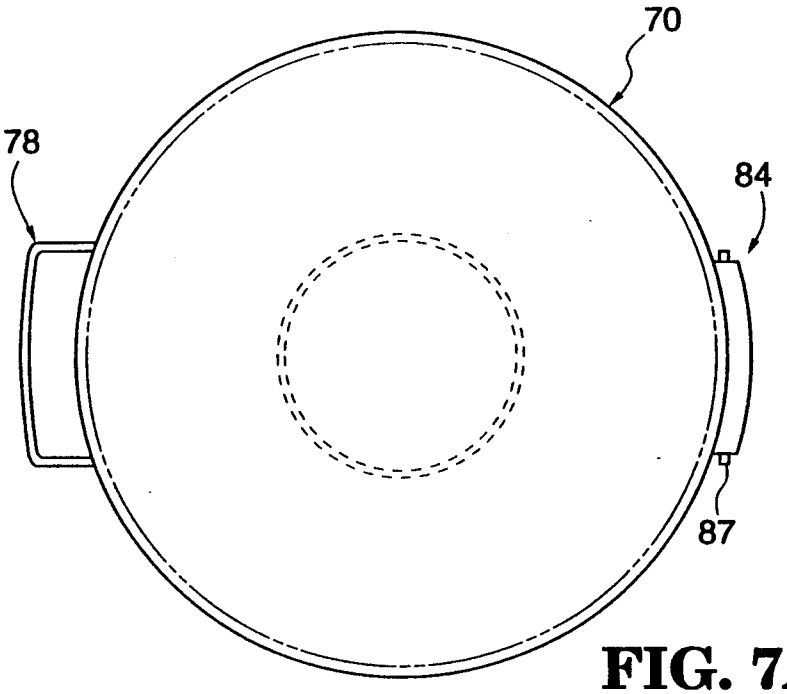
Figure 7B:
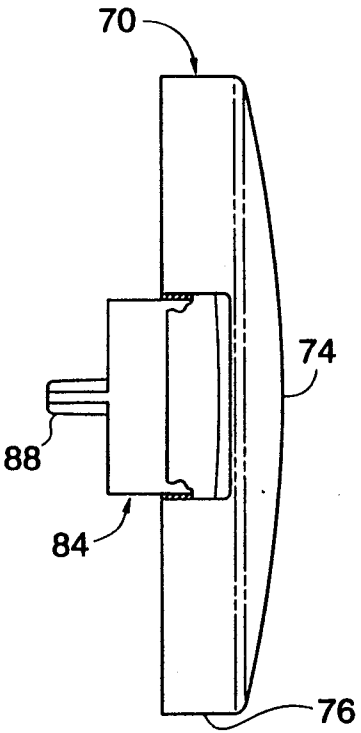
Figure 7D:
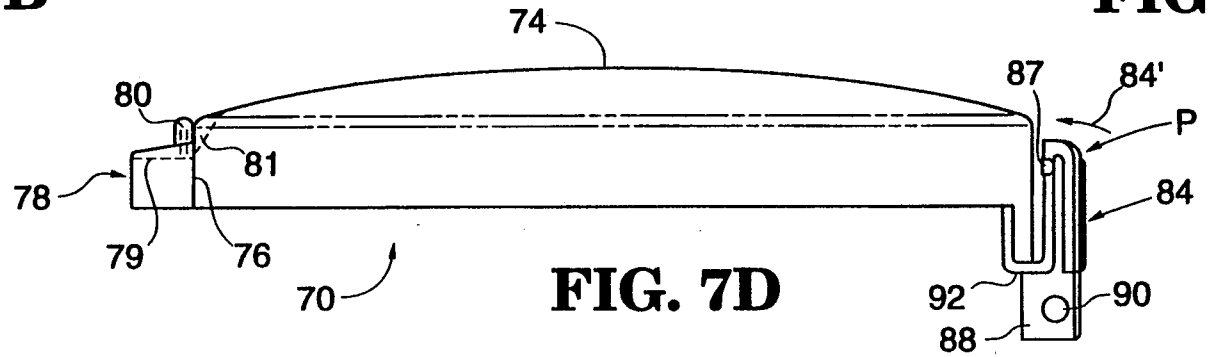

FIG. 6 presents a perspective view of a plug 120 to close the central opening 34 of the top housing 30 of this invention. Plug 120 preferably includes a top portion 122 that extends slightly beyond the diameter of the opening 34 and completely covers the central opening 34 of top housing 30, and a lower stem portion 124 that is adapted to be received within central opening 34. The lower stem portion 124 can additionally include an outer circumferential surface 124*a* that fits closely with the inner circumferential surface 34*a* (FIG. 5A) of the central opening 34 and includes a plurality of vertically grooved channels 126 circumferentially spaced about circumferential surface 124*a* to receive therein the elongated supports 104 of each of the specimen holders 100 to prevent their swaying and to maintain the circumferential spacing of the specimen holders suspended within the dewar. The underside surface of top portion 122 may also include grooved channels that correspond to the vertical grooves 126 provided on lower stem portion 124.

Referring now to FIGS. 7A–7D, this invention further provides a cover 70 adapted to be connected to the top housing 30 by a hinge 72 (see FIG. 2). Cover 70 preferably has a circular shape with a domed top portion 74 and a circular sidewall 76 (shown in partial breakaway cross section in FIG. 7C), and can be molded of a transparent material, such as GE's LEXAN brand polycarbonate, so that the indicia means, i.e., reference numerals 1–6 shown in FIGS. 2 and 3, are visible even when the cover 70 is in the closed position. Cover 70 additionally can include a hinge receiving portion 78 disposed along its periphery comprising a downwardly facing hinge plate-receiving surface 79 and hinge fastener-receiving holes 80. Strengthening ribs 81 can also be provided to impart additional strength to hinge-receiving portion 78.

Cover 70 can further include a releasable latch 84 is disposed along its periphery generally opposite hinge-receiving portion 78 to engage a latch-receiving opening 86 provided in the periphery of the top housing 30 (FIGS. 2 and 3) to maintain the cover in a closed position when desired. Latch 84 can include dog-like protrusions 87 extending laterally outwardly from each side of latch 84 adjacent its top and a portion 88 projecting downwardly from the central portion of the latch having an opening 90 formed therein. Latch 84 connects with the circular sidewall 76 of cover 70 by an outwardly extending resilient wall 92 (FIG. 7D), so that when slight hand pressure "P" is applied to the latch 84, the upper portion of latch 84 and protrusions 87 are urged inwardly, as shown by reference arrow 84' in FIG. 7D.

Cover 70 can be used to close and lock the dewar to prevent contamination of and unauthorized access to the specimens stored within the dewar. To close cover 70, the cover is moved downwardly and pressure "P" is applied to the upper portion of latch 84 urging protrusions 87 inwardly so that they move freely past shoulder portions 94 (FIGS. 2 and 3) of the latch-receiving opening 86 and the downwardly projecting portion 88 of latch 84 is received in vertical slot 96 provided in the latch-receiving opening 86 of top housing 30. When the wall 92 of the latch 84 abuttingly engages a horizontal stop surface 98 of latch-receiving opening 86, protrusions 87 snap outwardly immediately below shoulders 94 to retain cover 70 in the closed position. At this stage, downwardly projecting portion 88 of the latch extends through the slot 96 and beyond the stop surface 98 so that opening 90 in portion 88 is unobstructed, thereby permitting a user to place a tamperproof seal or other locking means through the opening 90 to effectively seal or lock the cover 70 in the closed position. To open an unlocked cover, slight hand pressure "P" can be applied to the latch 84 so that the latch is urged inwardly until dog-like protrusions 87 clear the shoulders 94 and permit cover 70 to be moved upwardly.

Figure 8B:
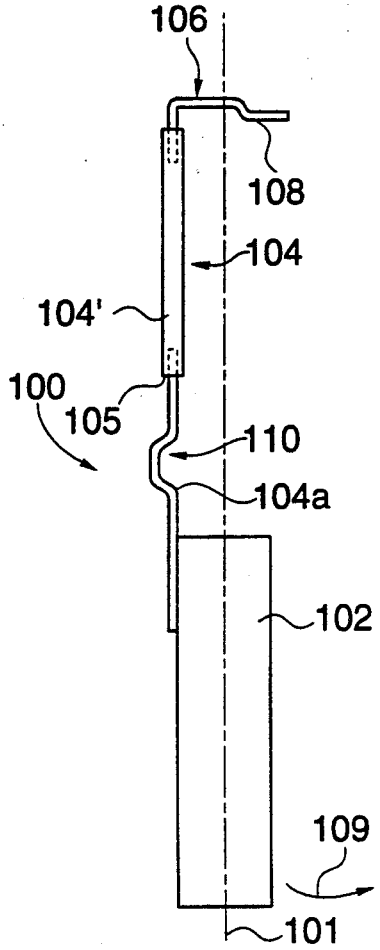
FIGS. 8A-8C present various views of a specimen holder of this invention.
Figure 8C:
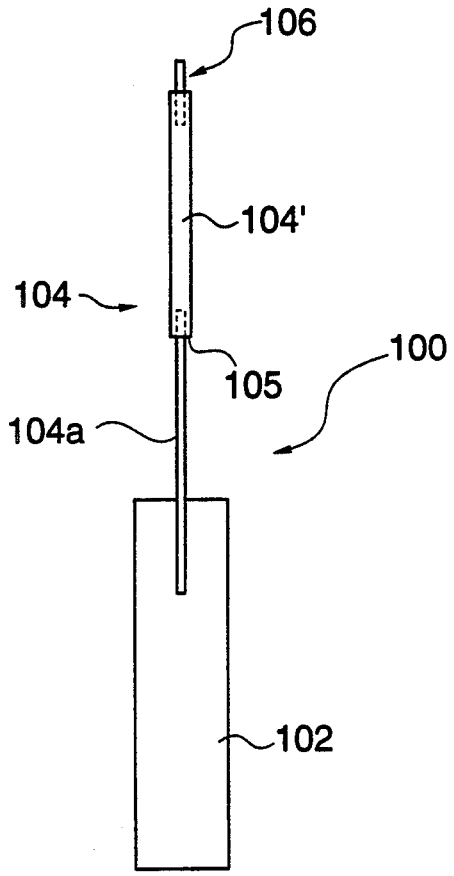
Figure 8A:
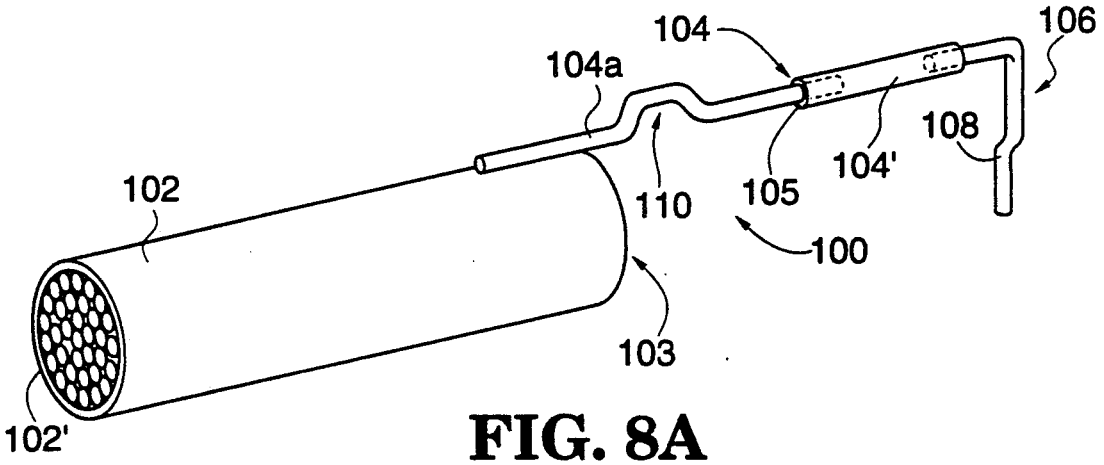

The specimen holder 100 provided by this invention is more completely shown in FIGS. 8A–8C. Specimen holder 100 comprises a cylindrical canister 102 and an elongated support 104 connected to one of the sides of canister 102 at its upper end. Canister 102 has an open end 103 and a perforated member 102' partially closing off the opposing end. Support 104 has at its distal end a projecting portion 106 that projects generally over and beyond the central portion of the canister 102, represented by central axis 101, with a dewar-engaging portion 108 that can be frictionally received within detent-forming legs 38 of annular portion 32. Dewar-engaging portion 108 lies sufficiently beyond the central axis 101 so that, when the material holder 100 is suspended within the dewar through the central opening 34 of the top housing 30, canister 102 is urged radially outwardly in the direction of the projecting portion 106 (as shown by reference arrow 109 in FIG. 8B) to avoid contact with other material holders suspended within the dewar. Such a dewar-engaging portion 108 can also act as a fulcrum for the suspended specimen holder. The positioning of the fulcrum of dewar-engaging portion 108 beyond the center axis 101 of canister 102 takes advantage of gravity in urging the canister radially outwardly toward the dewar walls to avoid contacting other canisters.

The elongated support 104 of canister 102 can also include a portion 104' made of thermal insulating material, such as nylon, polypropylene and glass reinforced epoxy tubing, to inhibit the transfer of heat between the canister 102 and projecting portion 106. Thermal insulating portion 104' can comprise a central plastic tube into which projecting portion 106 is inserted and adhesively attached at its upper end and a rod 104*a* is inserted and adhesively attached at its lower end connecting portion 104' to canister 102.

In use, small containers of refrigerateable human or animal body fluid samples are placed through open end 103 of canister 102 and the entire material holder 100 is then inserted through the central opening 34 of the top housing 30 so that the canister becomes immersed in the cold environment contained in the interior vessel of the dewar, which, of course, contains a cryogen such as liquid nitrogen. The projecting portion 106 of specimen holder 100 is then placed in one of the radial passageways 46 of annular rib 44 and the dewar-engaging portion 108 is snap-fitted into the corresponding detent-forming portion 36 to detachably secure the specimen holder in a spaced relationship within the interior of the dewar as best shown in FIG. 5A.

Specimen holder 100 can further include means for preventing a specimen holder from snagging on other specimen holders secured within the interior of the dewar as the specimen holder is being withdrawn therefrom. Specifically, when a specimen holder 100 is removed from within a dewar, it is disadvantageous if the upper end 103 of the canister, which comprises a thin wall, snags or catches on other specimen holders, particularly the lower end 105 of the central tube portion 104' of other specimen holders. Lower end 105 presents an edge that extends outwardly from canister-connecting rod 104*a*. Such snag-prevention means can include a tortuous or bent-shaped portion 110 of elongated support 104 located adjacent to the open upper end 103 of canister 102. Tortuously shaped portion 110 is preferably formed in canister connecting rod 104*a*. As shown best in FIGS. 8A and 8B, portion 110 extends outwardly away from the central axis 101 of canister 102 in the direction opposite of that of projecting portion 106. When the specimen holder 100 is being withdrawn from the interior of the dewar, portion 110 prevents the canister 102 from snagging on edge 105 by urging the canister 102 and its upper end 103 away from the point of engagement so that the open end 103 of the canister avoids the edge 105 of the elongated supports of other specimen holders within the dewar. Such means permits the unobstructed removal of the specimen holder 100 from the dewar interior.

The cryogenic dewar shipping system provided by this invention thus provides an improved handling of specimen holders, increased capacity within the dewar, improved identification of the specimens, and better protection of the specimens from contamination and unauthorized access. Furthermore, by detachably securing the specimen holders to the top housing 30, the specimen holders are more reliably shipped and identified than in conventional systems. Thus, this invention provides the cryogenic storage and transporting system disclosed above in connection with the embodiments of FIGS. 1–8. It must be understood, however, that the invention is not limited to the preferred embodiments and best mode of operation currently understood and described herein, but is only limited by the scope of the following claims.

What is claimed is:

1. A cryogenic dewar for shipping refrigerateable materials, said dewar including an outer casing and an inner vessel with each having small openings at their tops connected together by an air-tight neck portion forming an evacuable space between the outer casing and the inner vessel and a dewar opening into the inner vessel, said evacuable space containing thermal insulating material to inhibit the transfer of heat therethrough, characterized by:

a specimen holder comprising a canister having a central axis and an elongated support, said elongated support being connected at one end to one side of the canister and having at its other end a projecting portion extending generally over and beyond the central axis of the canister with a dewar-engaging portion that lies sufficiently beyond the central axis of the canister so that, when the specimen holder is suspended within the dewar through said dewar opening by the elongated support, the canister is urged by gravity in the direction of the projecting portion.

2. The cryogenic dewar of claim 1 characterized in that the elongated support of said canister includes a central tube of thermal insulating material into which the projecting portion is inserted at its upper end and a canister-connecting rod is inserted at its lower end.

3. The cryogenic dewar of claim 1 characterized in that said cryogenic dewar further includes a top housing adjacent said dewar opening for securing the specimen holder within said dewar.

4. The cryogenic dewar of claim 3 further characterized in that said top housing for securing said specimen holder within said cryogenic dewar includes frictional fitting means for detachably receiving the dewar-engaging portion of the elongated support of said specimen holder.

5. The cryogenic dewar of claim 1 further characterized in that the projecting portion of the elongated support of said material holder forms a fulcrum that engages the dewar adjacent the top opening so that when the specimen holder is suspended within the dewar, the canister is urged by gravity in the direction of the projecting portion of said elongated support.

6. The cryogenic dewar of claim 1 characterized in that said elongated support further includes means for preventing the specimen holder from snagging in the interior of the dewar as the specimen holder is being withdrawn from the interior of said dewar.

7. The cryogenic dewar of claim 6 further characterized in that said snag-prevention means includes a tortuously shaped portion of said elongated support located adjacent said canister.

8. The cryogenic dewar of claim 1 further characterized by a top housing secured over the top of the dewar opening, said top housing comprising an annular portion forming a central opening in communication with the dewar opening to allow the insertion and withdrawal of one or more specimen holders to and from the dewar, said annular portion further comprising a plurality of detent-forming portions circumferentially spaced about the central opening, each said detent-forming portion being adapted to releasably receive the dewar-engaging portion of the elongated support of said one or more specimen holders.

9. The cryogenic dewar of claim 8 characterized in that said annular portion further includes an annular rib circumferentially disposed between the central opening and plurality of detent-forming portions, said annular rib having a plurality of spaced radial passageways provided therein for freely receiving the projecting portions of the elongated supports of said material holders.

10. The cryogenic dewar of claim 8 further characterized by a plug member adapted to fit into and close the central opening of said top housing, said plug member including a plurality of vertical channels spaced about its periphery to maintain the circumferential spacing of the one or more specimen holders secured within said dewar.

11. The cryogenic dewar of claim 8 further characterized by a cover hingedly connected to said top housing, said cover including an integral releasable latch adapted to engage a latch-receiving opening provided in the periphery of said top housing to maintain the cover in a closed position, said latch having an opening formed therein for permitting said cover to be sealed in the closed position.

12. The cryogenic dewar of claim 8 characterized in that said top housing forms handle means for transporting said dewar.

13. In a sample holder employed in combination with a cryogenic storage dewar having a central opening therein, said sample holder including a canister with a central portion for carrying one or more refrigerateable samples and an elongated support attached to the canister at one end and having a projecting portion at its distal end for engaging said dewar and suspending said canister within the dewar from above the canister, the improvement wherein said projecting portion extends generally over and beyond the central portion of the canister and terminates in a downwardly bent dewar-engaging portion sufficiently beyond the central portion of the canister so that the canister is urged by gravity in the direction of the projecting portion, and said elongated support further includes a bent shape portion adjacent said canister that extends slightly outwardly from the elongated support and away from said canister.

14. A top housing for a cryogenic shipping vessel, said shipping vessel comprising a cryogenic dewar having a top opening for insertion and removal of sample holders, each said sample holder having a dewar-engaging support extending over the sample holder, said top housing comprising an annular portion forming a central opening in communication with the top opening of said dewar and means for detachably securing a plurality of sample holders within the dewar comprising a plurality of detent-forming portions formed in said annular portion at its top and circumferentially spaced about the central opening of said top housing for frictionally and detachably receiving the dewar-engaging supports so that the sample holders are urged by gravity in the direction of the dewar-engaging supports.

15. The top housing for a cryogenic storage vessel of claim 14 wherein said annular portion further includes an annular rib provided with a plurality of circumferentially spaced passageways for freely receiving the dewar-engaging support of each of said sample holders, each of said passageways being radially aligned with one of said plurality of detent-forming portions.

16. The top housing for a cryogenic storage vessel as in claim 14 further including indicia for identifying each of the sample holders stored within said dewar.

17. A liquid cryogenic shipping container comprising:

a dewar for storing a liquid cryogen including an outer casing and an inner vessel, each having an opening at their respective tops;

a neck portion providing a gas-tight connection between the openings of the outer casing and the inner vessel and forming with said outer casing and inner vessel an evacuable intervening space;

thermal insulation disposed between the outer casing and the inner vessel for inhibiting heat transfer therebetween;

at least one specimen holder adapted to be suspended within the liquid cryogen, said specimen holder including a cylindrical canister having an open upper end, a perforated lower base, and an elongated support connected at one side of the canister adjacent the open upper end and extending generally parallel with a central longitudinal axis of said canister, said elongated support having at its distal end a projecting portion extending generally over and beyond the central longitudinal axis of the canister and having a dewar-engaging portion that lies sufficiently beyond the central longitudinal axis so that, when the specimen holder is suspended within the dewar, gravity urges said specimen holder in the direction of the projecting portion, said elongated support further having in its end adjacent the canister a bent portion that extends slightly outwardly from the elongated support;

a top housing secured over the opening of the dewar including an annular portion forming a central opening corresponding with the top opening of said dewar to allow the insertion and withdrawal of said specimen holders, at least one detent-forming portion circumferentially spaced from the central opening adapted to releasably receive the dewar-engaging portion of the elongated support of the specimen holder, and an annular rib disposed between the central opening and the at least one detent-forming portion, including at least one radial passageway for freely receiving the dewar-engaging portion of said at least one specimen holder, said at least one radial passageway being aligned radially with said at least one detent-forming portion;

a plug adapted to fit into and close the central opening of said top housing, said plug including at least one vertically grooved channel in its periphery to engage the elongated support of said at least on specimen holder and inhibit movement of the specimen holder during movement of the dewar;

a cover hingedly carried by said top housing over said central opening, including an integrally molded latch to engage a latch-receiving opening formed in said top housing to releasably secure the cover in a closed portion, said latch and top housing having cooperating openings to permit the cover to be locked in the closed position; and indicia means provided on the top housing of the dewar for identifying said at least one specimen holder suspended within said dewar.

18. A top housing for a cryogenic shipping vessel, said shipping vessel comprising a cryogenic dewar having a top opening for insertion and removal of sample holders, each said sample holder including a dewar-engaging support, said top housing comprising a annular portion forming a central opening in communication with a top opening of said dewar, means for detachably securing said sample holders comprising a plurality of detent-forming portions circumferentially spaced about the central opening of said top housing for frictionally and detachably receiving the dewar-engaging supports of said sample holders and an annular rib provided with a plurality of circumferentially spaced passageways for freely receiving the dewar-engaging support of each of the sample holders, each of the passageways being radially aligned with one of the plurality of detent-forming portions.

* * * * *

UNITED STATES PATENT AND TRADEMARK OFFICE

CERTIFICATE OF CORRECTION

PATENT NO. : 5,321,955
DATED : Jun. 21, 1994
INVENTOR(S) : Rex D. Leonard

It is certified that error appears in the above-indentified patent and that said Letters Patent is hereby corrected as shown below:

On title page, item [73],

Insert --Assignee: International Cryogenics, Inc., Indianapolis, Indiana--.

In Col. 4, line 63, change "align" to --aligned--.

In Col. 10, line 40, after "at least", delete "on" and insert --one--.

In Col. 10, line 56, after "housing comprising", delete "a" and insert --an--.

Signed and Sealed this
Eighth Day of October, 1996

Bruce Lehman

*Attest:*

BRUCE LEHMAN

*Attesting Officer*

*Commissioner of Patents and Trademarks*